US007053144B1

(12) United States Patent
Immel

(10) Patent No.: US 7,053,144 B1
(45) Date of Patent: May 30, 2006

(54) HIGH DENSITY RUBBER COMPOUNDS

(75) Inventor: Karl Immel, Dallas, TX (US)

(73) Assignee: CMI Rubber Company, Inc., Garland, TX (US)

( * ) Notice: Subject to any disclaimer, the term of this patent is extended or adjusted under 35 U.S.C. 154(b) by 0 days.

(21) Appl. No.: 10/295,357

(22) Filed: Nov. 15, 2002

Related U.S. Application Data

(60) Provisional application No. 60/388,233, filed on Jun. 13, 2002.

(51) Int. Cl.
*A63B 21/06* (2006.01)

(52) U.S. Cl. ..... 524/432; 482/93; 482/105

(58) Field of Classification Search ..... 524/432; 482/93, 105
See application file for complete search history.

(56) References Cited

U.S. PATENT DOCUMENTS 4,483,537 A * 11/1984 Hanada et al. ..... 473/372
5,502,099 A * 3/1996 Wallace ..... 524/410
6,046,260 A * 4/2000 Hoover ..... 524/71
6,277,901 B1 * 8/2001 Hensel ..... 523/201
6,355,715 B1 * 3/2002 Ladd et al. ..... 524/432
6,589,630 B1 * 7/2003 Crow ..... 428/167
6,699,924 B1 * 3/2004 Daude ..... 524/431
6,710,114 B1 * 3/2004 Bissonnette et al. ..... 524/493

OTHER PUBLICATIONS

PROPOWERGEAR, LLC; "Our Products 'Maximizing the Human Potential'" (on-line catalog); Jun. 12, 2002; pp. 1-5; retrieved from www.propowergear.com/products.html.

* cited by examiner

*Primary Examiner*—Peter D. Mulcahy
(74) *Attorney, Agent, or Firm*—Howison & Arnott, L.L.P.

(57) ABSTRACT

A rubber compound comprising any raw rubber, from about 5% to about 75% by weight, and a zinc oxide dispersion, from about 25% to about 95% by weight. The specific gravity of the compound is within the range from about 1.4 gm/cc to about 3.4 gm/cc. The resulting material is a soft, pliable and flexible rubber with a relatively high specific gravity. Further, the compound is non-toxic, containing no known hazardous ingredients. The compound is a good alternative to metallic weights or metallic-filled rubbers currently used in the fields of sporting goods, exercise equipment, rehabilitation equipment, and any other manufacturing arenas.

13 Claims, 4 Drawing Sheets

HIGH DENSITY RUBBER COMPOUNDS

CROSS-REFERENCE TO RELATED APPLICATIONS

This application is related to, and claims the benefits of priority from, U.S. Provisional Patent Application Ser. No. 60/388,233, entitled "HIGH DENSITY RUBBER COMPOUNDS," filed Jun. 13, 2002.

TECHNICAL FIELD OF THE INVENTION

The current invention relates generally to rubber compounds, and more particularly, to rubber compounds containing very high quantities of zinc oxide dispersion yielding a flexible, soft and pliable rubber with a high specific gravity.

BACKGROUND OF THE INVENTION

A zinc oxide dispersion is a mixture comprising powdered or finely divided zinc oxide (ZnO) combined with various oils or other coatings. The specific gravity of a typical ZnO dispersion is 3.00–4.00 gm./cc. Many companies manufacture zinc oxide dispersions, e.g., Tiarco Chemical Company, Polychem Dispersions, Bayer Group, and many other raw rubber manufacturers and chemical manufacturers. One example of a zinc oxide dispersion is marketed by Tiarco Chemical Company under the trade name "Octocure 462." This material is approved by the U.S. Food and Drug Administration for use under the following: 21 C.F.R. Sections 175.105, 175.300, 176.170, 176.180, 176.210, 177.1210, 177.1650, and 177.2600.

It was previously known to use small quantities of zinc oxide dispersion in rubber compounds to serve as an activator in the curing and vulcanization of rubber, as a reinforcing agent adding durability and abrasion resistance, and as a material which aids in the protection of rubber from harmful UV rays. Previously, the normal use level for a zinc oxide dispersion was in the range from about 1% to about 5% by weight in a styrene butadiene rubber ("SBR") or natural latex compound.

Zinc oxide dispersions were previously added only in small quantities to raw rubber compounds because most raw rubber is intended for uses that a high concentration of a zinc oxide dispersion would degrade. Generally speaking, a vulcanized rubber part is rarely intended to sit idle and function as a weight or weighted item. Instead, most raw rubber, once vulcanized, is intended to give the end product a high tensile strength, a high modulus, resistance to heat and/or to cold, or good elongation. The addition of zinc oxide dispersions is known to reduce the strength, modulus, temperature resistance and elongation of rubber after curing. When only small amounts of zinc oxide dispersion (e.g., 1%–5%) are added to the rubber, the reduction in these properties is generally considered acceptable.

Further, it was heretofore believed that high concentration zinc oxide dispersion rubber compounds would be impractical and undesirable to use because the rubber compound in its raw (i.e., uncured) state was expected to be prone to melting, running and excessive stickiness. Such properties tend to make the raw rubber difficult or expensive to transport, store and handle.

Very heavy rubber compounds, i.e., those having a specific gravity exceeding about 2.0 gm/cc, are known which are hard and inflexible, suitable for use in simulating stationary objects, or for uses such as traffic barrier bases, wheel stops, etc. For example, some rubber compounds are loaded with clays or other high specific gravity filler materials to produce rubber compounds having specific gravities exceeding 5 gm./cc. However, the resulting compounds are not soft or flexible, and they do not easily conform to complex shapes such as the human body. Thus, these previously known heavy rubber compounds are not well suited for use as, e.g., flexible weights for weight suits for exercise and training, flexible scuba diving weights, belts and other items, or flexible rehabilitation devices, all of which require a rubber which is heavy while still being soft, pliable and flexible.

Previously, when soft, pliable and/or flexible rubber weights or other high-specific gravity components were needed, metallic lead, in the form of shot, pellets, or powder was often molded into the component. However, use of metallic lead in rubber components complicated the molding and production process, and lead's toxic properties made it unsuitable for many uses, including children's products, school equipment and sports equipment. Substitution of metallic steel or other non-toxic metals for the lead addressed the toxicity problem, but not the molding and production problems caused when trying to encapsulate metallic particles.

A need therefore exists, for soft, pliable and/or flexible rubber compounds which are non-toxic, contain no metallic particles, but have a high specific gravity.

Wearable weight systems are known comprising a fabric garment, e.g., vest, shirt, shorts, pants, body suit, socks, etc. having one or more pockets distributed across the garment holding weights or weighted pads. Such wearable weight systems allow the wearer to perform exercise or athletic training (e.g., football or basketball workouts) while carrying additional weight, but without unduly impeding the wearer's mobility. The weights and weight pads used for wearable weight systems have heretofore included metal weights, metal-filled rubber weights, and bulky sandbags or shot-filled bags. In some cases, these weights or weight pads were hard and inflexible, risking breakage of the pads or injury to the wearer (or others) during falls, collisions or impacts. In other cases, the prior art weights and weight pads were so thick and bulky that the wearer's mobility was somewhat restricted. In still other cases, the weights or weight pads included lead or other hazardous materials which were inappropriate for use around children or young persons.

A need therefore exists, for a wearable weight system including a garment with one or more pockets containing weights or weight pads of flexible rubber. Preferably, the weights or weight pads of the wearable weight system will contain no metallic components. More preferably, the weights or weight pads of the wearable weight system will contain no hazardous materials.

SUMMARY OF THE INVENTION

The present invention disclosed and claimed herein comprises, in one aspect thereof, a rubber compound comprising any raw rubber, from about 5% to about 75% by weight, and a zinc oxide dispersion, from about 25% to about 95% by weight. The specific gravity of the compound is within the range from about 1.4 gm/cc to about 3.4 gm/cc. The resulting material is a soft, pliable and flexible rubber with a relatively high specific gravity. Further, the compound is non-toxic, containing no known hazardous ingredients. The compound is a good alternative to metallic weights or metallic-filled rubbers currently used in the fields of sporting goods, exercise equipment, rehabilitation equipment, and any other manufacturing arenas.

The present invention disclosed and claimed herein comprises, in another aspect thereof, a flexible weight comprising a body formed of a rubber material including rubber, from about 5% to about 75% by weight, and zinc oxide, from about 25% to about 95% by weight. The body has a specific gravity within the range from about 1.4 gm/cc to about 3.4 gm/cc.

The present invention disclosed and claimed herein comprises, in yet another aspect thereof, a wearable weigh system for exercise and athletic training. The wearable weight system includes a garment body wearable by a human. At least one pocket is formed on the garment body for receiving a weight pad. The system further includes at least one weight pad dimensioned to be receivable within the pocket. Each weight pad is formed of a rubber material comprising natural or synthetic rubber, from about 5% to about 75% by weight, and zinc oxide, from about 25% to about 95% by weight, and having a specific gravity within the range from about 1.4 gm/cc to about 3.4 gm/cc.

The present invention disclosed and claimed herein comprises, in yet another aspect thereof, a flexible weight belt comprising a band portion and a fastener. The band portion is adapted to be wrapped around a user's waist and has two free ends. The fastener is connected to one of the free ends for detachably connecting the two free ends of the band portion together around the user's waist. A majority of the overall weight of weight belt constitutes the weight of rubber material comprising rubber, from about 5% to about 75% by weight, and zinc oxide, from about 25% to about 95% by weight.

The present invention disclosed and claimed herein comprises, in yet another aspect thereof, a flexible laminate material. The laminate material includes a first layer of a rubber material comprising rubber, from about 5% to about 75% by weight, and zinc oxide, from about 25% to about 95% by weight. A second layer of a complementary material is joined to the first layer. The resulting flexible laminate material has a specific gravity within the range from about 1.4 gm/cc to about 3.4 gm/cc.

The present invention disclosed and claimed herein comprises, in yet another aspect thereof, a method for producing a flexible rubber article having a predetermined thickness and a predetermined two-dimensional outline. A sheet of a cured rubber material is provided having a thickness equal to the predetermined thickness. The cured rubber material comprises rubber, from about 5% to about 75% by weight, and zinc oxide, from about 25% to about 95% by weight, and has a specific gravity within the range from about 1.4 gm/cc to about 3.4 gm/cc. The sheet of cured rubber material is positioned on a support structure in proximity to an automated cutting apparatus, the automated cutting apparatus being capable of producing a kerf through the sheet of cured rubber material when activated. The automated cutting apparatus is activated and the automated cutting apparatus is translated relative to the sheet of cured rubber material along a two-dimensional path substantially corresponding to the predetermined two-dimensional outline. In this manner, a kerf is produced through the sheet having the predetermined two-dimensional outline.

BRIEF DESCRIPTION OF THE DRAWINGS

FIG. 7*a* shows a sheet of vulcanized high-specific gravity flexible rubber material;

FIG. 7*b* shows an automated cutting apparatus moving across the sheet of FIG. 7*a;*

FIG. 7*c* shows the finished high-specific gravity rubber parts after separation from the sheet material;

DETAILED DESCRIPTION OF THE INVENTION

The current invention is described below in greater detail with reference to certain preferred embodiments illustrated in the accompanying drawings.

One embodiment of the current invention is a novel rubber compound that is extremely flexible, very soft and pliable after vulcanization (i.e., curing), and possesses a specific gravity within the range from about 1.1 gm/cc to about 3.5 gm/cc. The novel combination of different types of elastomers and extremely high concentrations of zinc oxide dispersion result in a heavy-weight material which is soft and flexible. Further, the compounds (after curing) are non-toxic, containing no known hazardous ingredients. All of these combined characteristics make the compounds of the current invention a very good alternative to metallic weights in the field of sporting goods, exercise equipment, rehabilitation equipment, and any other manufacturing arenas where metallic weighted items are currently used. The specific formulations and properties of the current invention are described further herein. Certain embodiments of the invention are sold by CMI Rubber Co., Inc. of Garland, Tex. under the trademark "HEAVIFLEX."

Figure 1:
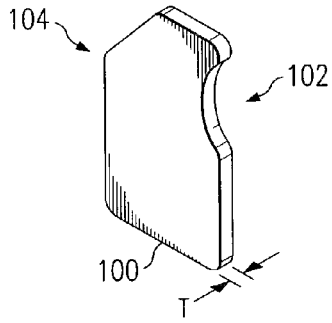
FIG. 1 is a perspective view of a flexible rubber weight pad formed from the high concentration zinc oxide dispersion rubber compounds of the current invention in accordance with one embodiment.

Referring now to FIG. 1, there is illustrated a flexible rubber weight pad (sometimes referred to simply as a "weight") in accordance with a first embodiment. As will be further described herein, such flexible weight pads may be used in conjunction with exercise suits or wet suits having pockets, or with other training, fitness, exercise or sport equipment. The weight pad 100 is formed from the high concentration zinc oxide dispersion rubber compounds described herein having a specific gravity within the range from about 1.4 gm/cc to about 3.4 gm/cc. In a preferred embodiment, the specific gravity is within the range from about 2.2 gm/cc to about 3.4 gm/cc. In a more preferred embodiment, the specific gravity is within the range from about 2.7 gm/cc to about 2.95 gm/cc. The weight pad 100 does not include any metallic components. The weight pad 100 may be flexible enough to be folded in half without cracking.

Since the weight pad 100 does not include any metallic components that need to be encapsulated, it can be molded with a very small thicknesses (designated by "T" in FIG. 1). For example, in some embodiments, the thickness T of the weight pad 100 is about 0.5 inches or less. In preferred embodiments, the thickness T of the weight pad 100 is within the range from about 0.3 inches to about 0.125 inches. The weigh pad 100 can be easily molded into complex shapes, e.g., with profile features 102 and 104. Alternatively, the weight pad 100 can be formed by producing sheets of the high concentration zinc oxide dispersion rubber and then cutting the weights from the sheet using conventional rubber-cutting methods, or by the use of other rubber forming methods described herein.

Figure 2:
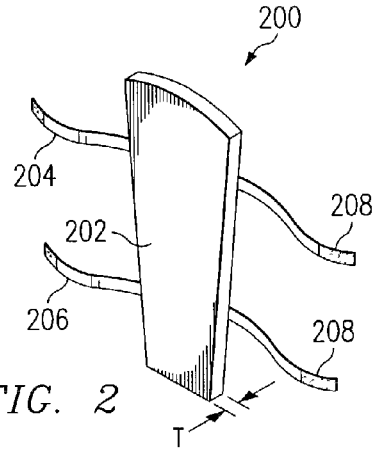
FIG. 2 is a perspective view of a rehabilitation device in accordance with another embodiment.

Referring now to FIG. 2, there is illustrated a flexible rubber rehabilitation device in accordance with yet another embodiment. The rehabilitation device 200 comprises a flexible weight member 202 and attachment straps 204 and 206. Weight member 202 is formed from the high concentration zinc oxide dispersion rubber compounds described herein having a specific gravity within the range from about 1.4 gm/cc to about 3.4 gm/cc. In a preferred embodiment, the rubber compound used for the rehabilitation device 200 has a specific gravity within the range from about 2.7 gm/cc to about 2.95 gm/cc. The weight member 202 is shaped to fit against, and/or wrap around, the patient's limb. The attachment straps 204 and 206 are then used to hold the weight member 202 against the patient. Fasteners 208, e.g., hook and loop material (e.g., "VELCR®"), buckles, snaps, etc., may be provided on the ends of attachment straps 204 and 206 for securing them together. As with the weight pad 100 previously described, the weight member 202 does not include any metallic components that need to be encapsulated, thus it can be molded with a very small thicknesses. For example, in some embodiments, the thickness T of the weight member 202 is about 0.5 inches or less. In preferred embodiments, the thickness T of the weight member 202 is within the range from about 0.3 inches to about 0.125 inches. The weigh member 202 can be molded directly in the desired shape, formed by cutting from a sheet of the high concentration zinc oxide dispersion rubber, or formed using other methods described herein.

In certain embodiments, the flexible weight member 202 is provided with a fabric cover or "skin" (not shown) which serves to protects its rubber surface from nicks or abrasions. The fabric cover may be made of woven or non-woven materials, preferably materials which are soft but durable. In these embodiments, the cover is not bonded to the weight member 202, but rather forms a cavity into which the weight member is inserted and secured. When a cover is used, the attachment straps 204 and 206 may be attached to the cover rather than directly to the weight member 202, thereby allowing the apparatus 200 to be attached to the wearer.

Figure 3A:
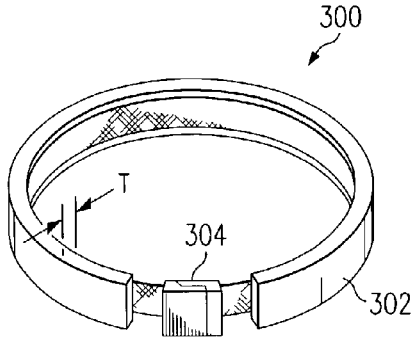
FIG. 3*a* is a perspective view of a flexible weight belt in accordance with yet another embodiment.

Referring now to FIG. 3*a*, there is illustrated a flexible rubber weight belt for use in scuba diving or other types of watersport recreation in accordance with still another embodiment. Weight belt 300 comprises a flexible strap member 302 and buckle 304. The strap member 302 is formed from the high concentration zinc oxide dispersion rubber compounds described herein having a specific gravity within the range from about 1.4 gm/cc to about 3.4 gm/cc. The buckle 304 is made in a conventional fashion, but may also be formed of hook and loop material, snaps, laces, etc. As with the previously described articles, the strap member 302 may be formed without any metallic components that need to be encapsulated, thus it can be molded with a very small thicknesses. For example, in some embodiments, the thickness T of the strap member 302 is within the range from about 3.0 inches to about 0.125. In preferred embodiments, the thickness T of the strap member 302 is within the range from about 1.5 inches to about 0.75 inches. The strap member 302 can be molded directly in the desired shape, or formed by cutting from a sheet of the high concentration zinc oxide dispersion rubber. The majority of the overall weight of the weight belt 300 constitutes the weight of the high concentration zinc oxide dispersion rubber present in the belt. In a preferred embodiment, at least 75% of the overall weight of the weight belt 300 constitutes the weight of the high concentration zinc oxide dispersion rubber present in the belt. In a more preferred embodiment, at least 90% of the overall weight of the weight belt 300 constitutes the weight of the high concentration zinc oxide dispersion rubber present in the belt. The use of high concentration zinc oxide dispersion rubber having a specific gravity within the range from about 2.7 gm/cc to about 2.95 gm/cc is well-suited for these embodiments. It will be appreciated that the flexible weight belt 300 can also be used for general fitness conditioning or athletic training.

Figure 3B:
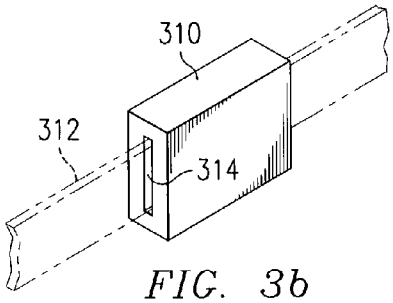
FIG. 3*b* is a perspective view of a flexible weight for a weight belt in accordance with still another embodiment.

Referring now to FIG. 3*b*, there is illustrated a flexible rubber weight for a weight belt in accordance with still another embodiment. The flexible weight 310 may be used on a weight belt 312 (shown in broken line) for use in scuba diving or other types of recreation or exercise activities. The flexible weight belt 310 includes a slot or passage 314 formed therethrough to allow it to be selectively added to, or removed from, the belt 312. The flexible weight 310 is formed from the high concentration zinc oxide dispersion rubber compounds described herein having a specific gravity within the range from about 1.4 gm/cc to about 3.4 gm/cc, and preferably within the range from about 2.7 gm/cc to about 2.95 gm/cc. As with the previously described articles, the flexible weight 310 does not require any metallic components that need to be encapsulated, nor any loading components other than zinc oxide. The weights 310 of some embodiments may be from 0.5 inches to 3.0 inches thick.

Figure 3C:
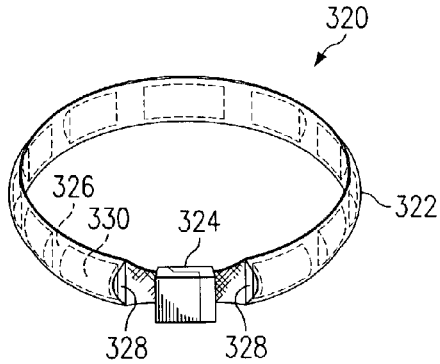
FIG. 3*c* is a perspective view of a flexible weight belt with removable weights in accordance with yet another embodiment.

Referring now to FIG. 3*c*, there is illustrated another flexible weight belt in accordance with yet another embodiment. The flexible weight belt 320 comprises a tubular strap member 322 and buckle 324. The tubular strap member 322 is formed from conventional fabric, e.g., nylon, and has one or more cavities 326 formed along its length. The cavities are accessible via openings 328 which can be secured with snaps, Velcro®, or other conventional fasteners. Flexible weights 330 (shown in broken line) having various weight values may be inserted into the cavities 326 to provide a user-selectable overall weight for the belt 320. The flexible weights 330 are formed from the high concentration zinc oxide dispersion rubber compounds described herein having a specific gravity within the range from about 1.4 gm/cc to about 3.4 gm/cc. As with the previously described articles, the flexible weights 330 do not require any metallic components that need to be encapsulated, nor any loading components other than zinc oxide. The buckle 324 may be made in a conventional fashion, but it may also be formed of hook and loop material, snaps, laces, etc. The majority of the overall weight of the weight belt 320 constitutes the weight of the high concentration zinc oxide dispersion rubber present in the belt. In a preferred embodiment, at least 75% of the overall weight of the weight belt 320 constitutes the weight of the high concentration zinc oxide dispersion rubber present in the belt. In a more preferred embodiment, at least 90% of the overall weight of the weight belt 320 constitutes the weight of the high concentration zinc oxide dispersion rubber present in the belt.

The novel combinations of different types of elastomers and extremely high concentrations of zinc oxide dispersion of the current invention result in a weighted material that is both flexible and soft after vulcanization. For the high concentration zinc oxide dispersion rubber compounds of the current invention, it is preferred to use a zinc oxide dispersion having a specific gravity within the range of about 3.4 gm/cc to about 3.6 gm/cc.

Figure 4:
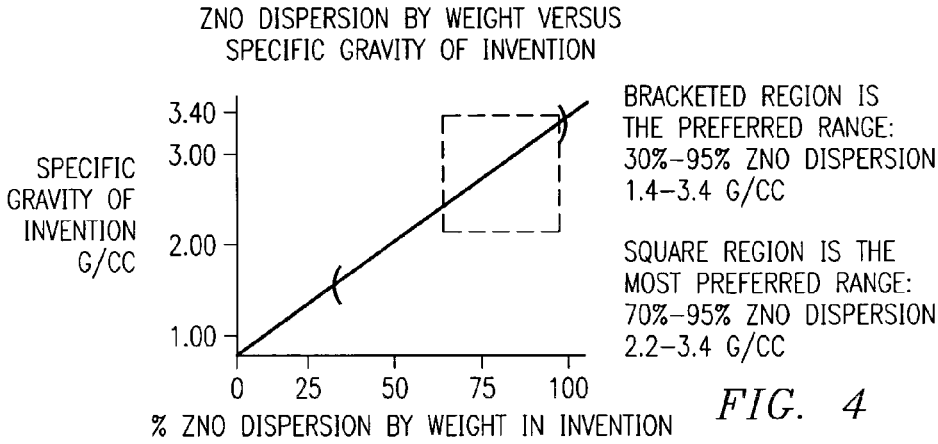
FIG. 4 is a graph of weight percent of zinc oxide dispersion vs. specific gravity of the final rubber compounds.

Referring now to FIG. 4, there is illustrated a graphical definition of the invention in terms of the relationship between weight percent of zinc oxide dispersion and specific gravity of the final compound. Also shown in FIG. 4 are the preferred and most preferred ranges for the relevant variables.

Figure 5:
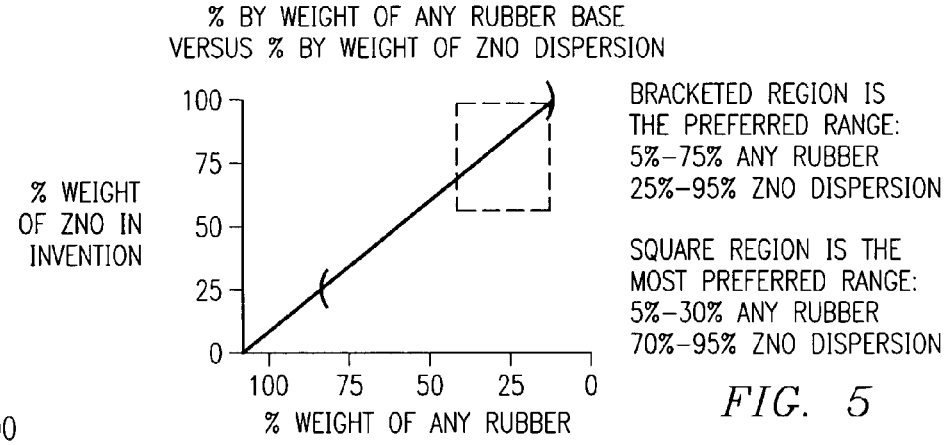
FIG. 5 is a graph of weight percent of rubber vs. weight percent of zinc oxide dispersion in the rubber compounds.

Referring now to FIG. 5, there is illustrated a graphical definition of the invention in terms of the relationship between weight percent of rubber and weight percent of zinc oxide dispersion. Also shown in FIG. 5 are the preferred and most preferred ranges for the relevant variables.

The current invention includes rubbers having the following formulations:

EXAMPLE 1

| CONSTITUENT | Weight % Most Preferred | Weight % Preferred Range | Weight % Max Range |
|---|---|---|---|
| Any rubber compound (natural or synthetic) | 12.5 | 5–30 | 5–75 |
| Zinc oxide dispersion | 87.5 | 70–95 | 25–95 |

EXAMPLE 2

| CONSTITUENT | Weight % Most Preferred | Weight % Preferred Range | Weight % Max Range |
|---|---|---|---|
| SBR rubber compound | 12.5 | 5–30 | 5–75 |
| Zinc oxide dispersion | 87.5 | 70–95 | 25–95 |

EXAMPLE 3

| CONSTITUENT | Weight % Most Preferred | Weight % Preferred Range | Weight % Max Range |
|---|---|---|---|
| Natural rubber compound | 12.5 | 5–30 | 5–75 |
| Zinc oxide dispersion | 87.5 | 70–95 | 25–95 |

EXAMPLE 4

| CONSTITUENT | Weight % Most Preferred | Weight % Preferred Range | Weight % Max Range |
|---|---|---|---|
| SBR/Natural rubber blended compound | 12.5 | 5–30 | 5–75 |
| Zinc oxide dispersion | 87.5 | 70–95 | 25–95 |

The rubber compounds of the current invention have physical characteristics (after curing) as shown in TABLE 1 below. These characteristics are quite distinct from those of previously known high-specific-gravity rubber compounds.

TABLE 1

Ranges of Observed Physical Characteristics

| Characteristic | Most Pref'd Range | Preferred Range | Max. Range |
|---|---|---|---|
| Tensile strength (PSI) | 300–400 | 200–1200 | 200–2000 |
| Durometer Hardness (Shore-A Pts.) | 14–40 | 14–65 | 14–75 |
| Elongation (% of original) | 300–1000 | 150–1500 | 150–3000 |
| Specific Gravity (gm/cc) | 2.7–2.95 | 2.0–3.4 | 1.1–3.5 |

While the formulations of the rubber compounds of the current invention are unique, the basic constituents are readily available. Thus, the raw rubber base with the desired zinc oxide dispersion may be obtained from any reputable raw rubber company that makes dispersions and good raw rubber molding compounds. The known curing parameters for curing an elastomer with an added zinc oxide dispersion can be used for curing the current invention without undue experimentation. Once this has been accomplished, the manufacturer of this invention can then follow proper rubber molding techniques to fully practice the invention.

With regard to curing and molding parameters, once the raw rubber/zinc oxide dispersion compound has been obtained, it is placed in a mold and subjected to a pressure within the range from about 100 PSI to about 3000 PSI for a long enough period to cure the part. Simultaneously, the temperature of the mixture is raised to within the range from about 240° F. to about 370° F. It will be appreciated that, to a certain extent, the pressure, the temperature and the length of time needed to adequately cure the compound are co-variant and also depend upon the thickness of the part being molded. The curing time can thus range from about 7 minutes to about 75 minutes. For example, a typical rubber article with thickness of about 0.25 inch has a preferred curing time of about 15 minutes, a preferred curing temperature of about 320° F. and a preferred curing pressure of about 1000 PSI.

It will be appreciated that, in some cases, molding and curing of relatively thin layers of the high concentration zinc oxide dispersion rubber is easier to accomplish than molding and/or curing a single thick layer. It has been determined that the high concentration zinc oxide dispersion rubbers of the current invention are suitable for post-vulcanization bonding using conventional post-vulcanization rubber bonding agents and bonding procedures. Thus, relatively thick sheets of high concentration zinc oxide dispersion rubber may be formed by bonding together multiple thin sheets of previously cured material. Post-vulcanization bonding may also be used to assemble the high concentration zinc oxide dispersion rubber into complex configurations, e.g., configurations having passageways, cavities or varying cross-sections, or to attach components made from other materials to the rubber components.

Figure 6:
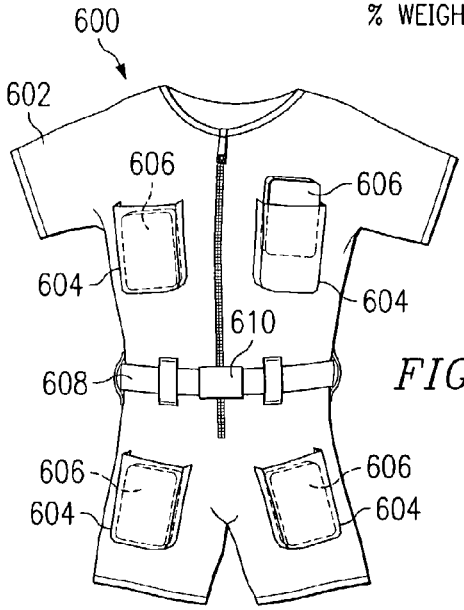
FIG. 6 shows a wearable weight system in accordance with another embodiment of the invention.

Referring now to FIG. 6, there is illustrated a wearable weight system in accordance with another aspect of the invention. The wearable weight system 600 comprises a garment 602 having one or more pockets 604 distributed across the garment holding weighted pads 606. The wearable weight system 600 may be used for land-based (i.e., "terrestrial") applications, e.g., football or sports training, exercise, physical fitness, or for water-based (i.e., "aquatic") applications, e.g., scuba diving or snorkeling. In terrestrial embodiments, the garment 602 may be fabricated from conventional woven fabrics such as nylon, polyester, cotton, etc. In aquatic embodiments, the garment 602 may be a rubberized (e.g., neoprene) wetsuit, or it may be made from conventional woven fabric and sized to fit over or under a wearer's wetsuit. In either case, the garment 602 is provided with one or more pockets 604 specifically adapted to receive the flexible rubber weights 606. The garment may also have features adapted to retain the weight pads 606 within the pockets 604, either through elastic tension of the material of the pocket, or by means of retaining straps (not shown) which may be selectively fastened over the open end of the pocket.

In the embodiment shown in FIG. 6, the garment 602 is styled as a body suit, but it will be appreciated that other garment types, e.g., vests, shirts, shorts, pants, socks, shoes, etc. could be used in alternative embodiments of the invention. It will be understood that, regardless of configuration, each garment 602 will include one or more pockets 604 holding a high specific gravity flexible rubber weight pad 606.

The weight pads 606 used in the wearable weight system 600 are formed of a high concentration zinc oxide dispersion rubber compound as previously described, i.e., a rubber compound having about 5% to about 75% natural or synthetic rubber, by weight, and about 25% to about 95% zinc oxide dispersion, by weight. Preferably the wearable weight system 600 includes weight pads 606 formed of a rubber compound having 5% to 30% natural or synthetic rubber, by weight, and 70% to 95% zinc oxide dispersion, by weight. Further, the weight pads 606 will be soft and flexible, with physical characteristics within the ranges indicated in TABLE 1. In most embodiments, the weight pads 606 will have no metallic components. Further, in preferred embodiments, the weight pads 606 of the system 600 will contain no lead or other hazardous materials.

Optionally, the wearable weight system 600 may also include a rubber weight belt 608 that can be fastened around the wearer's waist using buckle 610. If present, the weight belt 608 (exclusive of the buckle 610) may also be formed of a high concentration zinc oxide dispersion rubber compound having 5% to 75% natural or synthetic rubber, by weight, and 25% to 95% zinc oxide dispersion, by weight. Preferably the weight belt 608 is formed of a rubber compound having 5% to 30% natural or synthetic rubber, by weight, and 70% to 95% zinc oxide dispersion, by weight. Further, the weight belt 608 will be soft and flexible, with physical characteristics within the ranges indicated in TABLE 1. In most embodiments, the weight belt 608 will have no metallic components except (possibly) for the buckle 610. Further, in preferred embodiments, the weight belt 608 of the system 600 will contain no lead or other hazardous materials.

Figure 7A:
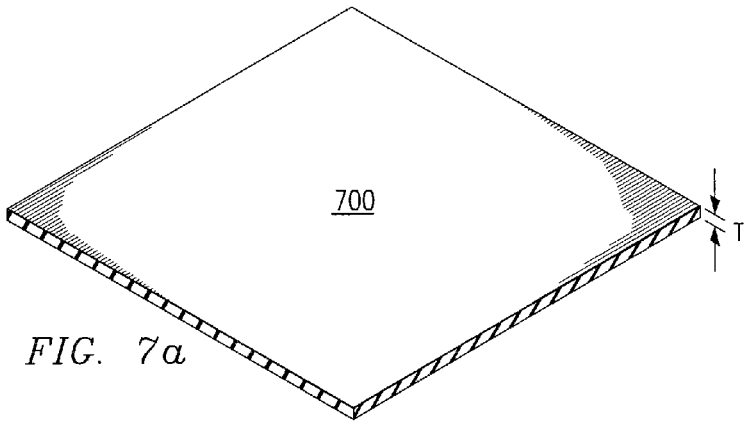
FIGS. 7*a*–7*c* illustrate a method of producing high-specific gravity flexible rubber parts in accordance with another embodiment; In particular.
Figure 7B:
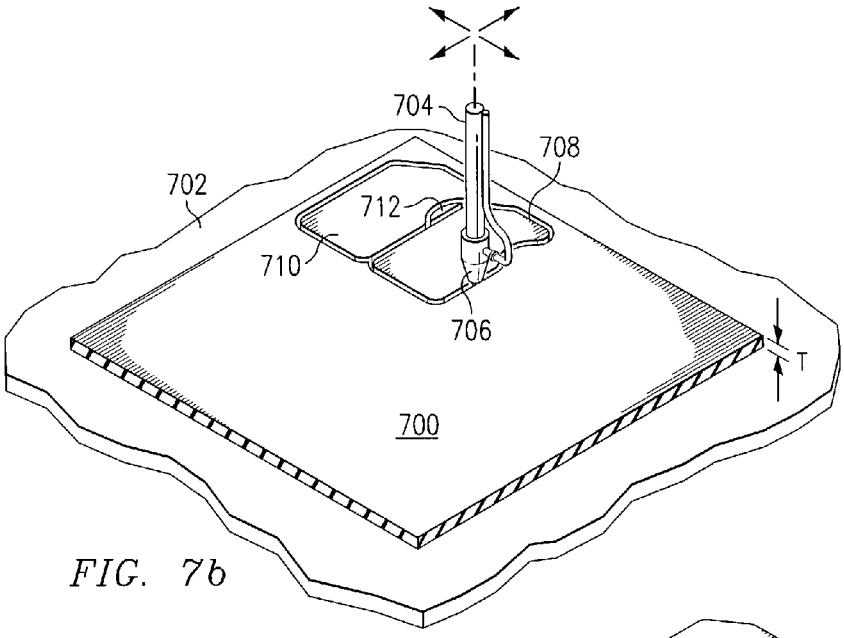
Figure 7C:
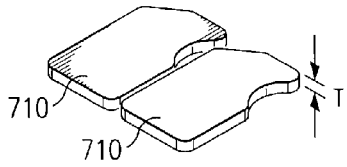

Referring now to FIGS. 7*a*–7*c*, there is illustrated a method of producing high-specific gravity flexible rubber parts in accordance with another embodiment. As previously described, articles formed of the high concentration zinc oxide dispersion rubber compounds described herein may be molded using conventional cavity-type molds. However, the tooling for cavity-type molds is relatively expensive, and such molds may be labor intensive to use since the raw rubber is typically loaded into the cavity by hand. Notwithstanding the expense, the use of cavity-type molds may be indicated where the rubber articles being produced have three-dimensional contours. On the other hand, where the rubber articles being produced have only two-dimensional contours (e.g., "flat" articles having a constant thickness), alternatives to conventional cavity-type molds may have numerous advantages.

FIG. 7*a* shows a sheet of vulcanized (i.e., cured) rubber formed from the high concentration zinc oxide dispersion rubber compounds described herein. The sheet 700 has been cured using the parameters previously described herein resulting in a specific gravity within the range from about 1.4 gm/cc to about 3.4 gm/cc. In a preferred embodiment, the sheet 700 has a specific gravity within the range from about 2.2 gm/cc to about 3.4 gm/cc. In a more preferred embodiment, the sheet 700 has a specific gravity within the range from about 2.7 gm/cc to about 2.95 gm/cc. The sheet 700 may have any desired length and width dimensions. The thickness of the sheet 700 (denoted by "T" in FIG. 7*a*) is selected to match the thickness of the two-dimensionally contoured articles to be formed. Since the rubber of sheet 700 has been cured, it can be stored at uncontrolled room temperature (e.g., 130° F. or more) as may be encountered in a warehouse without melting, running or exhibiting excessive stickiness like the uncured compound may do at such elevated temperatures. If desired, cured sheets 700 having various thicknesses T may be formed in advance and stored for immediate use when orders for products are received.

FIG. 7*b* illustrates how two-dimensional shapes may be cut from the pre-cured rubber sheet 700 to form high-specific gravity rubber articles. The pre-cured rubber sheet 700 is placed on the surface of a support table 702. An automated cutting apparatus 704, typically under computer control, translates back and forth along a predetermined path above the table 702. As the cutting apparatus 704 moves relative to the table 702, a cutting head 706 may be activated to produce a kerf 708 through the rubber of the sheet 700 in the shape of the desired part 710. The kerf 708 thus defines the two-dimensional contours of the rubber article 710, while the thickness T of the sheet 700 defines the third dimension. In this manner, one or more articles having any two-dimensional configuration may be produced from a single rubber sheet 700, whether multiple copies of a single configuration, or many separate configurations. It will be appreciated that, when the configuration of the desired rubber article includes holes, the automated cutting apparatus may be repeatedly activated an deactivated as it translates over the sheet so that only the desired portions of the sheet are cut out.

In the illustrated embodiment, automated cutting apparatus 704 is a conventional high pressure water-jet cutter, however, it will be appreciated that other types of automated cutting equipment, e.g., knives, saws, hot-wire cutters and lasers, may be used without departing from the scope of the invention. Further, depending upon the type of cutting apparatus used, it will be appreciated that in some cases the cutting apparatus 704 will move while the table 702 remains stationary, while in other cases the cutting apparatus remain stationary while the table moves.

After the cutting operation is complete, the high-specific gravity rubber articles 710 may be removed from the sheet 700, and any waste portions of the sheet, e.g., notch 712, are removed and discarded. If significant areas of the sheet 700 are not used, they may be returned to storage for use in manufacturing additional article at another time.

FIG. 7*c* shows some of the finished high-specific gravity rubber parts 710 after separation from the sheet 700. It will be appreciated that the parts 710 have thickness T corresponding to the thickness T of the original sheet 700, and a specific gravity corresponding to the specific gravity of the original sheet. Thus, the parts 710 have a specific gravity within the range from about 1.4 gm/cc to about 3.4 gm/cc. In a preferred embodiment, the parts 710 have a specific gravity within the range from about 2.2 gm/cc to about 3.4 gm/cc. And in a more preferred embodiment, the parts 710 have a specific gravity within the range from about 2.7 gm/cc to about 2.95 gm/cc. It is believed that manufacturing high-specific gravity rubber articles having a two-dimensional configuration using the methods described herein may have substantial advantages in terms of speed, flexibility and labor costs when compared to articles formed using cavity molds.

Figure 8A:
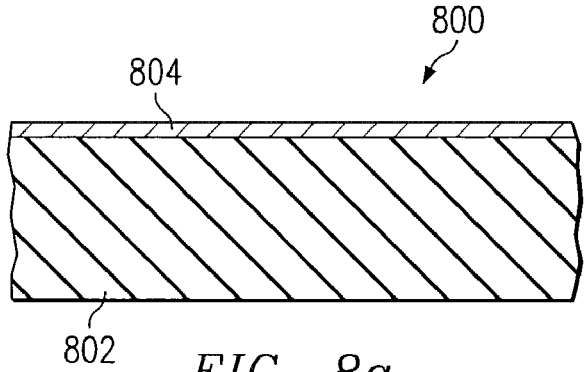
FIG. 8*a* shows a cross-sectional view of a high-specific gravity flexible laminate material in accordance with another embodiment.

Referring now to FIG. 8*a*, there is illustrated a cross sectional view of a sheet of high-specific gravity flexible laminate material in accordance with yet another embodiment of the invention. The laminate material sheet 800 includes a first layer 802 of a high concentration zinc oxide dispersion rubber compound bonded to at least one additional layer 804 of a complementary material, i.e., something other than high concentration zinc oxide dispersion rubber. The high concentration zinc oxide dispersion rubber of first layer 802 has a specific gravity within the range from about 1.4 gm/cc to about 3.4 gm/cc. In a preferred embodiment, the rubber of layer 802 has a specific gravity within the range from about 2.2 gm/cc to about 3.4 gm/cc. And in a more preferred embodiment, the rubber of layer 802 has a specific gravity within the range from about 2.7 gm/cc to about 2.95 gm/cc. The complementary material of the additional layer(s) 804 may be a different rubber compound or it may be a non-rubber material. Examples of such non-rubber materials that may be used for the complementary material of layer(s) 804 include, without limitation, paper, cardboard, fabric (i.e., either woven or non-woven), plastic and polymer material (e.g., films, coatings) and metal (e.g., foil, sheet, screen). Any conventional method for bonding the layers 802 and 804 together may be used, e.g., the layers may be formed separately and then bonded together, e.g., with adhesive, or the layers may be bonded together during the curing and/or hardening of one or both of the layers.

Figure 8B:
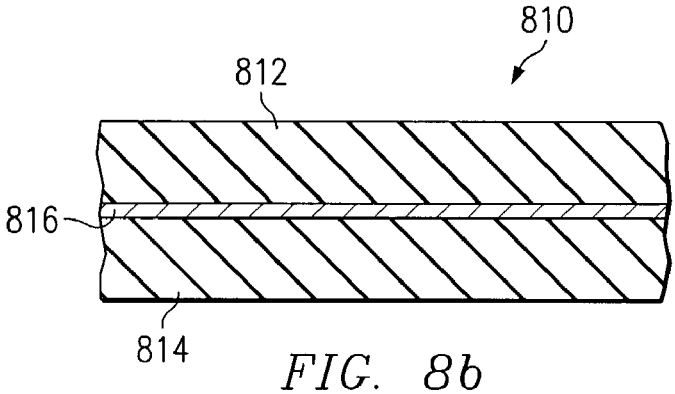
FIG. 8*b* shows a cross-sectional view of another high-specific gravity flexible laminate material.

Referring now also to FIG. 8*b*, there is illustrated a cross sectional view of an alternative embodiment of high-specific gravity flexible laminate material. The alternative laminate material sheet 810 includes two outer layers 812 and 814 formed of high concentration zinc oxide dispersion rubber compounds (as previously described) bonded on opposite sides of a third layer 816 formed of a complementary material. It will be appreciated that the high concentration zinc oxide dispersion rubber compounds of layers 812 and 814 may be identical, or they may be different from one another.

Figure 8C:
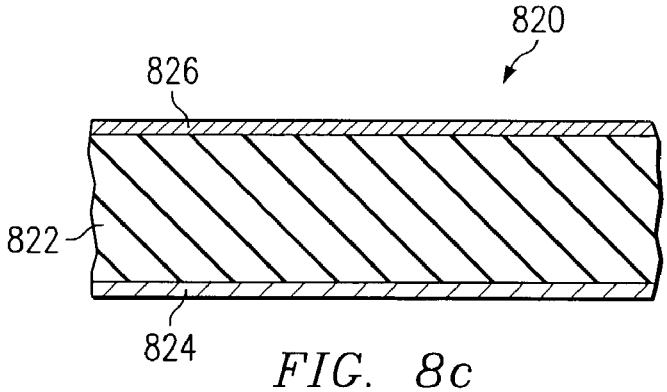
FIG. 8*c* shows a cross-sectional view of yet another high-specific gravity flexible laminate material.

Referring now also to FIG. 8*c*, there is illustrated a cross sectional view of yet another alternative embodiment of high-specific gravity flexible laminate material. The alternative laminate material sheet 820 includes one layer 822 formed of a high concentration zinc oxide dispersion rubber compound (as previously described) bonded between two outer layers 824 and 826 of complementary materials. It will be appreciated that the complementary materials of layers 824 and 826 may be identical, or they may be different from one another. It will further be appreciated that embodiments of high-specific gravity flexible laminate materials having any number of layers of high concentration zinc oxide dispersion rubber and/or any number of layers of complementary materials bonded one another will be within the scope of the current invention.

Typically, the complementary materials are selected to provide the high-specific gravity flexible laminate material with improved properties compared to a sheet composed of only the high concentration zinc oxide dispersion rubber, but without unduly interfering with the inherent flexibility of the material. For example, layers of complementary material bonded to the outer surface of the sheet (as in FIGS. 8*a* and 8*c*) may be used to provide improved wear resistance or to prevent sticking, while layers of complementary material disposed within the sheet (as in FIG. 8*b*) may be used to reinforce sheet.

It will be appreciated that where the layer(s) of complementary material are relatively thin compared to the layer(s) of high concentration zinc oxide dispersion rubber, the use of complementary materials having a relatively low specific gravity will not cause the overall specific gravity of the high-specific gravity flexible laminate material, e.g., sheet 800, 810 or 820, to fall significantly below the specific gravity of the high concentration zinc oxide dispersion rubber. Thus, the overall specific gravity for the high-specific gravity flexible laminate material will be within the range from about 1.4 gm/cc to about 3.4 gm/cc. In a preferred embodiment, the flexible laminate material has a specific gravity within the range from about 2.2 gm/cc to about 3.4 gm/cc. And in a more preferred embodiment, the flexible laminate material has a specific gravity within the range from about 2.7 gm/cc to about 2.95 gm/cc.

The high-specific gravity flexible laminate material just described may be fabricated into high-specific gravity flexible articles using the methods previously described herein. In particular, flexible two-dimensional articles may be formed from sheets of high-specific gravity flexible laminate material, e.g., sheets 800, 810 or 820, utilizing automated cutting equipment and methods substantially identical to those illustrated in FIGS. 7*a*–7*c*. It will be appreciated that certain cutting equipment, e.g., water-jet cutters, are particularly well suited for cutting through composite materials including paper, fabrics and films.

Articles may also be formed from the high concentration zinc oxide dispersion rubber using extrusion technology. This can be done with either a "hot" feed extruder or a "cold" feed extruder. Uncured high concentration zinc oxide dispersion rubber is fed into an opening in the top of the extruder and a screw in the interior of the extruder pushes the rubber down the barrel. At the end of the barrel is a die having one or more passageways having the desired cross-sectional profile. The raw rubber is continuously expelled through the die, causing it to conform to the cross-sectional profile of the die. The uncured extrusion is then cut to a desired length and cured. Curing may be performed in a conventional fashion, e.g., by microwave oven, autoclave, etc. Once cured, the extrusion can then be sliced into many pieces, all having the identical desired cross-section. It is believed that extrusion processes may be particularly useful for making thick belts for scuba/weight training purposes, weight pads, or other articles. One advantage to this type of manufacture is that there is relatively little waste.

While the invention has been shown or described in a variety of its forms, it should be apparent to those skilled in the art that it is not limited to these embodiments, but is susceptible to various changes without departing from the scope of the invention.

What is claimed is:

1. A flexible weight, comprising:

a body having a sheet configuration with a generally constant thickness;

the body being formed of a rubber material including a rubber compound selected from the list of natural rubber, SBR rubber, and a blended mixture of natural rubber and SBR rubber, from about 5% to about 75% by weight, and zinc oxide dispersion having a specific gravity within the range from about 3.00 gm/cc to about 4.00 gm/cc, from about 25% to about 95% by weight;

the body having a specific gravity within the range from about 1.4 gm/cc to about 3.4 gm/cc; and the body having a flexibility after vulcanization characterized by a Durometer hardness (shore-A scale) within the range from about 14 points to about 75 points.

2. A flexible weight in accordance with claim 1, wherein the body has a specific gravity within the range from about 2.2 gm/cc to about 3.4 gm/cc.

3. A flexible weight in accordance with claim 2, wherein the body has a specific gravity within the range from about 2.7 gm/cc to about 2.95 gm/cc.

4. A flexible weight in accordance with claim 1, wherein the weight includes no discrete metallic components encapsulated within the rubber body.

5. A flexible weight in accordance with claim 1, wherein zinc oxide dispersion is the sole loading components in the rubber compound.

6. A flexible weight in accordance with claim 1, wherein the body is formed from multiple layers of cured rubber which are bonded together after curing of the individual layers.

7. A flexible weight in accordance with claim 1, wherein the combined weight of the rubber compound and the zinc oxide dispersion constitute at least 95% of the overall weight.

8. A flexible weight, comprising:

a body having a generally rectangular sheet configuration including four edges;

the body being formed of a rubber material including a rubber base, from about 5% to about 30% by weight, and zinc oxide dispersion, from about 70% to about 95% by weight, the combined weight of the rubber base and the zinc oxide dispersion constituting at least 95% of the overall weight of the body; and the body having a flexibility after vulcanization characterized by a Durometer hardness (Shore-A scale) within the range from about 14 points to about 75 points.

9. A flexible weight in accordance with claim 8, wherein the configuration of the body includes profile features cut into the edges of the rectangular body.

10. A flexible weight in accordance with claim 8, wherein the rubber material of the body includes about 12.5% by weight of the rubber base and about 87.5% by weight of the zinc oxide dispersion.

11. A flexible weight, comprising:

a body configured in the shape of a relatively flat sheet, the body being formed of a rubber material including rubber, from about 5% to about 30% by weight, and zinc oxide dispersion having a specific gravity within the range from about 3.00 gm/cc to about 4.00 gm/cc, from about 70% to about 95% by weight; and the body having a flexibility after vulcanization characterized by a Durometer hardness (Shore-A scale) within the range from about 14 points to about 75 points and an elongation limit within the range of about 150% to about 3000%.

12. A flexible weight in accordance with claim 7, wherein the rubber base is selected from a list including natural rubber, SBR rubber and a blended mixture of natural rubber and SBR rubber.

13. A flexible weight in accordance with claim 11, wherein the rubber material of the body includes about 12.5% by weight of the rubber base and about 87.5% by weight of the zinc oxide dispersion.

* * * * *